US005915594A

United States Patent [19]

Nakata

[11] Patent Number: 5,915,594

[45] Date of Patent: Jun. 29, 1999

[54] DEVICE FOR OPENING A SEALANT CONTAINER, SEALANT CONTAINER, AND METHOD OF OPENING THE SEALANT CONTAINER

[76] Inventor: Keiichi Nakata, 4-6, Ishiodai 4-chome, Kasugai-shi, Aichi, Japan

[21] Appl. No.: 08/863,299

[22] Filed: May 27, 1997

[30] Foreign Application Priority Data

May 27, 1996 [JP] Japan ..... 8-156274

[51] Int. Cl.[6] ..... B67B 7/24

[52] U.S. Cl. ..... 222/81; 222/82

[58] Field of Search ..... 222/81, 82; 401/134, 401/135

[56] References Cited

U.S. PATENT DOCUMENTS 4,456,150 6/1984 Yang .

FOREIGN PATENT DOCUMENTS 0003039 7/1979 European Pat. Off. .
0154345 9/1985 European Pat. Off. .
0377287 7/1990 European Pat. Off. .
0385603A1 9/1990 European Pat. Off. .
7-145662 6/1995 Japan .
A-7-145662 6/1995 Japan .
645293 10/1950 United Kingdom .
2100237 12/1982 United Kingdom .

*Primary Examiner*—Steven O. Douglas
*Attorney, Agent, or Firm*—Birch, Stewart, Kolasch & Birch, LLP

[57] ABSTRACT

A sealant container eliminates the need for an additional operation for breaking a sealing section of the sealant container in addition to a sealant ejecting operation, as well as the need for another tool completely different from the sealant container. An opener for use with this sealant container has a cylindrical hollow shape, which is open at both ends, and a cutting section provided at one axial end of the opener, and a slit formed in the axial direction of the opener, and a notch formed in a portion of the cutting section. The opener is provided in a neck of the sealant container. If a sealant is pressed by a sealant extruding apparatus, an inner wall of the base end of the neck for permitting the discharging of a sealant which is sealed by the sealing section comes into contact with the cutting section of the opener to break under the pressure exerted on the sealant.

26 Claims, 11 Drawing Sheets

DEVICE FOR OPENING A SEALANT CONTAINER, SEALANT CONTAINER, AND METHOD OF OPENING THE SEALANT CONTAINER

BACKGROUND OF THE INVENTION

1. Field of the Invention

The present invention relates to a device for opening a sealant container, a sealant container, and a method of opening the sealant container.

2. Description of the Related Art

Various types of sealant have already been in actual use for sealing or filling a variety of types of gap occurring in facilities or equipment of a building, and the gaps are filled with the sealant. A container filled with the sealant is formed into a cartridge of such a size suitable for attaching to an extruding device which can be operated at a work place. The cartridge is made of thick cardboard, synthetic resin, metal, or a composite material consisting of a combination thereof. Since the material to be filled in the container is reactive with moisture, oxygen, etc., in the air, a seal-like sealing section—which consists of a metal film or a composite material comprised of metal and a plastic film—must be stuck to or tensilely attached to an outlet or its vicinity.

FIG. 1 illustrates one example of a conventional sealant container. As illustrated in the drawing, the sealant container having a sealant K therein is comprised of a hollow container body D, a nozzle N screwed to the front end of the container body D, a bottom enclosure T provided at the rear end of the container body D so as to be slidable along the inner wall of the container body D, and a sealing section F which is made of a sealing metal film and is stuck to the inside of the container body D so as to face the nozzle N as well as to seal the sealant.

To extrude a sealant from the sealant container illustrated in FIG. 1, the nozzle N is removed, and the sealing section F is broken by a sharp tip of a wire. Then, the nozzle N is reattached to the container body D. The tip end of the nozzle N is cut along line B—B indicated by a two-dot chain line in FIG. 1, and the sealant container is then fitted into the sealant extruding device. The bottom enclosure T is forced towards the nozzle N to thereby extrude the sealant.

Unexamined Japanese Patent Application No. Hei-5-316003 (Unexamined Japanese Patent Publication No. Hei-7(1995)-145662) discloses a sealant container and an opener for use therewith as illustrated in FIG. 2. In this sealant container, a sealing section 103 consisting of a metal film is provided in a container body 120, and an opener 100 with a cutter 102 is provided in the vicinity of the sealing section 103. In the case of the sealant container illustrated in FIG. 2, a nozzle 140 is previously cut along line B—B in FIG. 2, and this sealant container is then fitted into a sealant extruding device. As a result of forcing the bottom enclosure 124 of the sealant container toward the nozzle 140 through use of the sealant extruding device, pressure is applied to a sealant K, causing the opener 100 to break the sealing section 103 to thereby extrude the sealant from the nozzle 140.

In the case of the conventional sealant container filled with a sealant, when the sealant container is used, it is necessary to remove a cap-shaped nozzle from the tip end of the sealant container as an additional operation under structural constraints. Further, after the sealing section labeled to or tensilely attached to the inside of the sealant container has been broken by a tool having a sharp front end, the cap-shaped nozzle must be reattached to the sealant container, thereby resulting in a lot of expense in effort. If the sealing section is broken through use of the tool, the tool may be stained with the sealant.

The sealant filled in the sealant container has the property of setting by reaction with the air. More specifically, the sealant sets within several seconds. Even in the case of a sealant which sets slowly, it will set in about ten minutes. For these reasons, it is impossible to maintain a plurality of sealant containers in a usable state while the sealing sections of the sealant containers are open. In short, it is necessary to open the sealant containers one at a time by breaking the sealing section immediately before using it. It may present an inconvenience to a worker depending on working conditions.

Further, the sealant container and the opener disclosed in Unexamined Japanese Patent Application No. Hei-5-316003 incur the risk of breaking the sealing section by the opener when the sealant is filled in the sealant container.

SUMMARY OF THE INVENTION

Accordingly, the present invention has been conceived to solve the foregoing drawbacks in the related art, and the primary object of the present invention is to provide a sealant container opener which eliminates the need for another operation in addition to an operation for extruding the sealant and the need to break a sealing section through use of a tool requiring effort; which prevents the sealant from setting within the sealant container; and which enables facilitated filling of the sealant into the sealant container. Other objects of the present invention are to provide a sealant container which uses the sealant container opener and a method of opening the sealant container.

To achieve the foregoing and other objectives, and in accordance with the purposes of the present invention, an opener breaks a sealing section which is provided in a sealant container in order to shield a sealant filled in a sealant container from outside air. The opener is characterized by the fact that it has a hollow shape which is open at both ends, and a cutting section is provided at one axial end of the opener.

This opener is provided in a neck of a sealant container. A sealing section is attached so as to cover an outlet port of the bottom end of the neck which permits the discharge of a sealant. The sealant container equipped with is opener is set in a sealant extruding apparatus, and this sealant extruding apparatus is actuated such that the sealant is extruded. The sealant is then pressed against the sealing section, in turn bringing the sealing section into pressed contact with the cutting section of the opener. As a result, the sealing section is broken. Therefore, it is not necessary to break sealing sections one at a time requiring effort by another operation, as is the case with the conventional sealant container. Further, it is not necessary to break the sealing section through use of another tool. Consequently, the filling efficiency can be improved. Furthermore, since it is not necessary to open the sealing section with a tool for opening purposes in another operation, there is no risk of staining the tool.

Preferably, a slit is formed in the opener in its axial direction. As a result, the opener can be easily provided in the neck of the sealant container. Further, the elastic action of the slit resulting from its opening or closing action enables reliable pressed fitting of the opener to the inner wall of the neck. The slit enables a certain limited extent of contraction of the outer diameter of the opener, and it therefore becomes possible for the opener to flexibly cope with variations in the inner diameter of the neck of the sealant container.

Preferably, a notch is formed in the end of the opener which is formed into the cutting section. The cutting section formed at the end of the opener, with the exception of the notch, should preferably have a substantially wedge-shaped cross section. As a result, both ends of the notch become pointed, which fractures the sealing section. Therefore, the sealing section can be broken in a short period of time.

Preferably, the foregoing cross-section of the opener has a substantially circular or polygonal cross section. As a result, the opener can be fitted into the neck of the sealant container having a substantially circular cross section, so that the opener is reliably fitted into the internal wall of the neck.

Preferably, a flange is formed so as to protrude along the periphery of the end of the opener opposite to its end formed into the cutting section. So long as an annular groove is formed in the internal wall of a nozzle which covers a neck like a cap, the flange fits into the annular groove, enabling fixing of an opener to the nozzle.

In accordance with another aspect of the present invention, there is provided a sealant container which stores a sealant and is used for filling desired areas with the sealant. The sealant container is characterized by comprising a main body and a nozzle attached to the neck of the main body like a cap. The main body is comprised of a neck for permitting the discharging of the sealant, and a sealing section provided at an outlet of the base end of the neck or on the internal wall in the vicinity of the outlet in order to shield the sealant from the outside air.

In this sealant container, the sealing section is provided at the outlet port of the base end of the neck to permit the discharging of the sealant or in the vicinity of the outlet port. As a result, the sealing section shields the sealant from the outside air. So long as an opener with a cutting section is disposed in the neck, and the sealant is pressed while the sealant container is fitted into the sealant extruding apparatus, the sealing section is pressed against the cutting section of the opener to thereby be fractured. Therefore, it is not necessary to break sealing sections one at a time at the expense of effort in another operation, as is the case with the conventional sealant container. Further, it is not necessary to break the sealing section through use of another tool, enabling filling efficiency.

Preferably, the joint between the base end of the neck and the outlet port is curved, and a regulating wall is formed in the nozzle such that the cutting section of the opener is held in close proximity to the sealing section within the neck while the nozzle is attached to the neck. As a result, a space is formed between the front edge of the cutting section and the joint. Further, since the opener is held in close proximity to the sealing section by means of the regulating wall, the sealing section can be broken much more reliably.

Preferably, the annular groove is formed in the nozzle so as to receive the flange. As a result, the opener with the flange can be reliably fixed to the nozzle by the annular groove.

In accordance with still another aspect of the present invention, there is provided an opener for breaking a sealing section which is provided in a sealant container so as to shield a sealant from the outside air. The opener has a hollow shape which is open at both ends, and a cutting section is provided at one axial end of the opener. The opener should preferably be provided in the neck, eliminating the need to break sealing sections one at a time at the expense of effort in another operation, as is the case with the conventional sealant container. Further, it becomes unnecessary to break the sealing section through use of another tool, which enables improvements in the filling efficiency.

In accordance with a further aspect of the present invention, there is provided a method of opening a sealant container. The sealant container includes a container main body and an opener. The container main body for housing the sealant is comprised of a neck for permitting discharging of the sealant, a sealing section for shielding the sealant from the outside air provided at an outlet port of the base end of the neck or in the inner wall in the vicinity of the outlet port, a bottom enclosure for sealing the sealant, and a nozzle attached to the neck of the main body like a cap. The opener is provided in the neck and has a hollow shape, which is open at both ends, and a cutting section provided at one axial end of the opener. With this arrangement, the sealant container opening method includes the steps of setting the sealant container—which is used for filling desired areas with a sealant—in a sealant extruding apparatus, and actuating the sealant extruding apparatus to thereby press the bottom enclosure of the sealant container, so that the sealing section is brought into pressed contact with the cutting section and is fractured.

As a result, it is possible to extrude the sealant by breaking the sealing section in a very easy operation.

Still other objects of the present invention will become readily apparent to those skilled in this art from the following description wherein there are shown and described preferred embodiments of the present invention, simply by way of illustration of some of the modes best suited to carry out the present invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings, incorporated in and forming a part of the specification, illustrate several aspects of the present invention, and together with the description serve to explain the principles of the invention. In the drawings.

Reference will now be made in detail to the present preferred embodiments of the invention, examples of which are illustrated in the accompanying drawings.

DESCRIPTION OF THE PREFERRED EMBODIMENTS

In references to the accompanying drawings, descriptions will be hereinbelow given of preferred embodiments of the present invention; more particularly, preferred embodiments of an opener for use with a sealant container and a sealant container accommodating this opener according to the present invention. A sealant used in the embodiments includes a caulking compound.

Figure 3A:
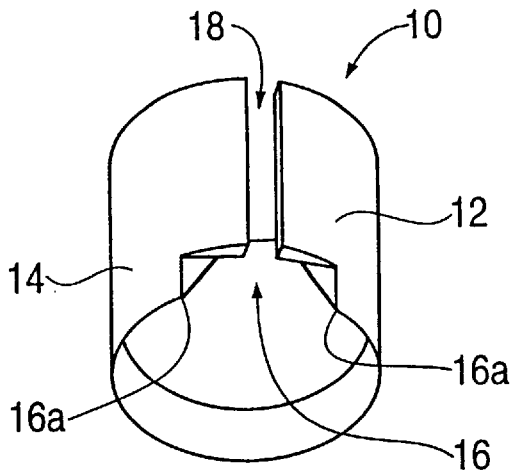
FIG. 3*a* is a perspective view illustrating an opener according to a first embodiment of the present invention.
Figure 3B:
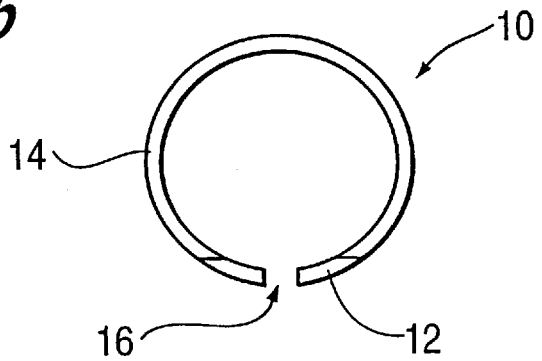
FIG. 3*b* is a bottom view of the opener in FIG. 3*a;*

First, with reference to FIGS. 3*a*, 3*b*, and 3*c*, an opener for use with a sealant container according to a first embodiment of the present invention will be described.

An opener 10 for use with a sealant container according to the first embodiment is comprised of a main body 12, a cutting section 14, a notch 16, and a slit 18. The opener 10 is entirely hollow and open at both of its longitudinal ends, and this hollow opener 10 has a cylindrical shape but may also have a polygonal shape.

The main body 12 is formed from polyethylene into a hollow cylinder. The main body 12 has such an outside diameter as to enable fitting into the inside diameter of a neck 26 of a sealant container A1 (see FIG. 5), which will be described later. A slit 18 is formed longitudinally in the main body 12. More specifically, as illustrated in FIG. 3*b*, the slit 18 forms at least a portion of the circumference of the main body 12, providing the main body 12 with a substantially circular C-shaped cross section.

The cutting section 14 is formed integrally with one longitudinal end of the main body 12 and into an external circuit offset bite, thereby having a wedge-shaped cross section. In short, the cutting section 14 is formed along the entire circumference of the end of the main body 12 with exception of the notch 16, as if it were formed by cutting the outer circumference of the end of the main body 12.

Figure 3C:
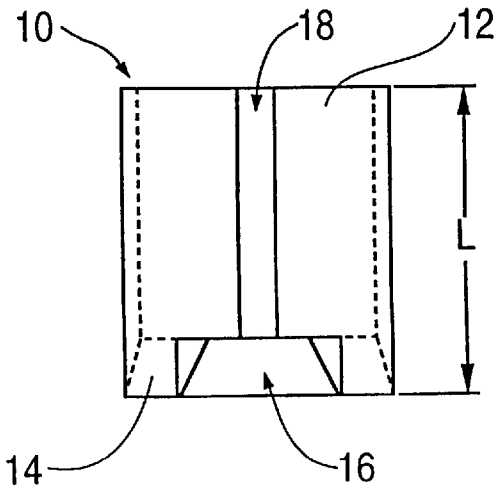
FIG. 3*c* is a front view of the opener in FIG. 3*a;*
Figure 5:
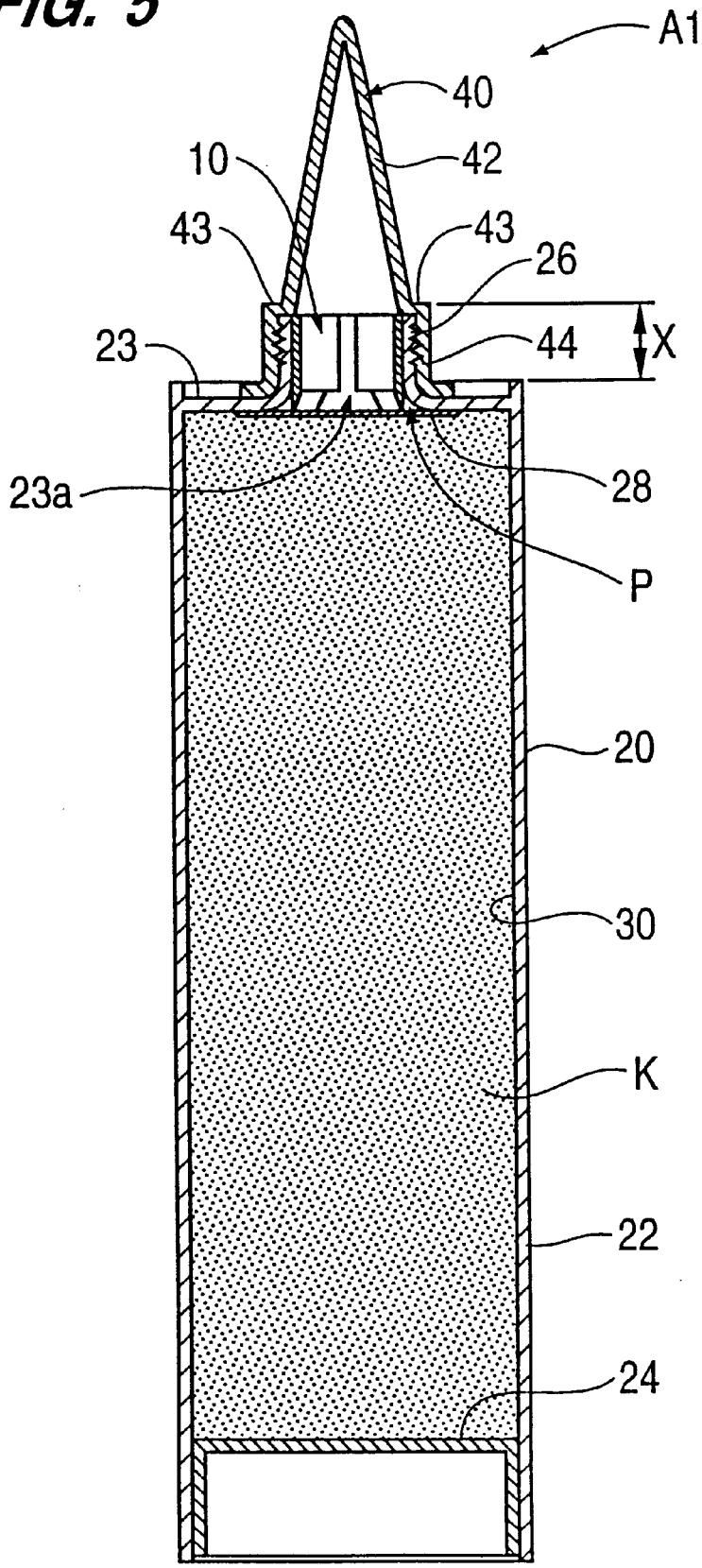
FIG. 5 is a longitudinal cross-section of a sealant container according to the first embodiment.

As illustrated in FIGS. 3*c* and 5, a length L which is a total of the length of the main body 12 and the length of the cutting section 14 equals a length X between the innermost end of the neck 26 of the sealant container A1, which will be described later, and an outlet port 23*a* of the container main body 20 of the sealant container A1.

The notch 16 is formed in one portion of the cutting section 14 in a substantially rectangular form so as to have a larger width than that of the slit 18 and communicate with the slit 18. Further, the notch 16 is formed such that the slit 18 is positioned substantially at the longitudinal center of the notch 16. Since the cutting section 14 has a substantially-wedge shaped cross section, edges 16*a* at both longitudinal ends of the notch 16 become pointed.

The diameter of the opener 10 is substantially equal to the inner diameter of the neck 26 of the sealant container A1, which will be described later. The slit 18 is formed at the longitudinal center of the notch 16 from the upper end of the main body 12 so as to communicate with the cutting section 14. The opener 10 is formed from polyethylene, and the above-described constituent sections 12, 14, 16 and 18 are integrally formed with the opener 10 as a whole.

The sealant container A1 which uses the opener 10 having the foregoing structure will be described.

Figure 4:
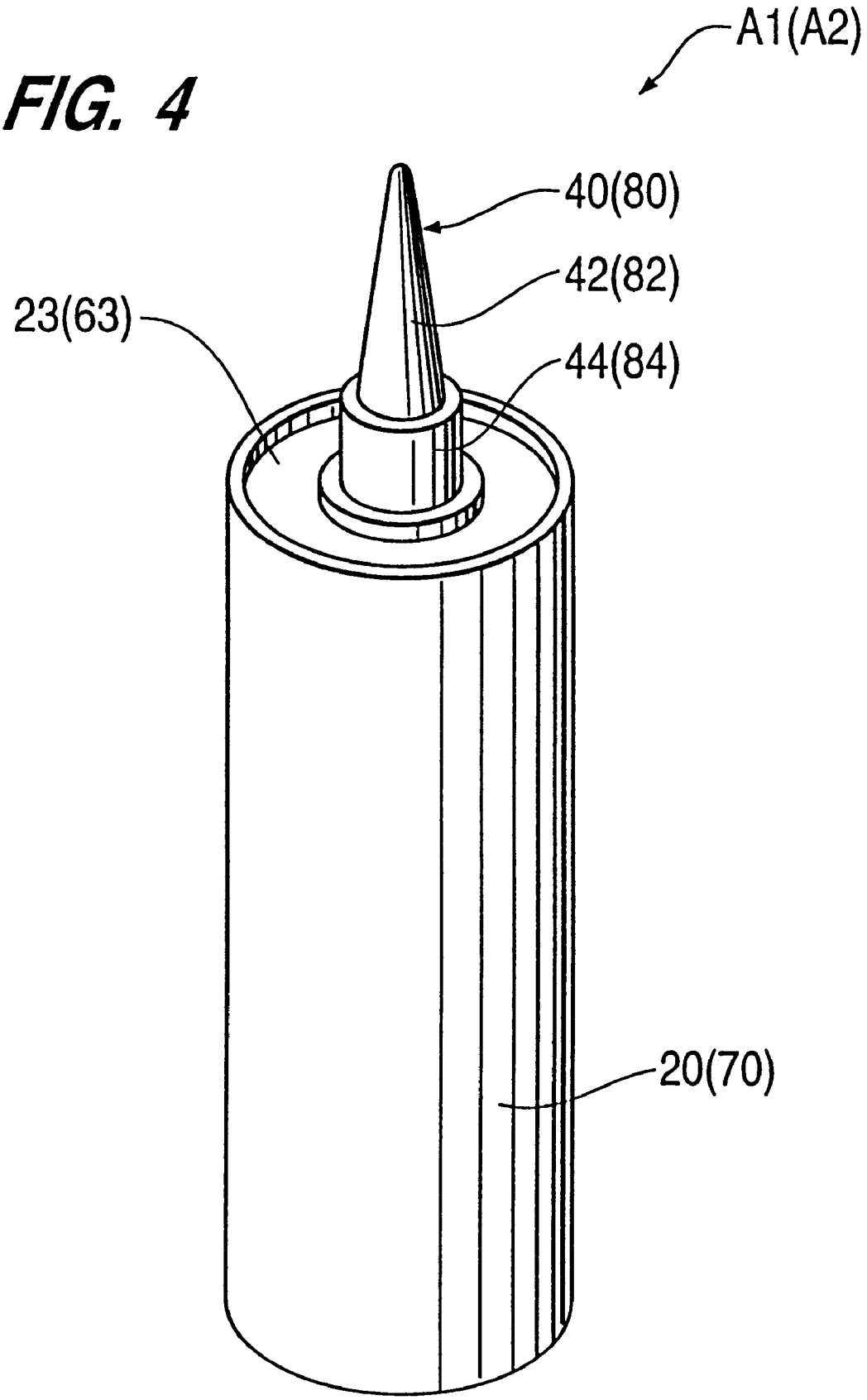
FIG. 4 is a perspective view showing sealant containers according to first and second embodiments of the present invention.

As illustrated in FIGS. 4 and 5, the sealant container A1 is comprised of the container main body 20, a nozzle 40, and the opener 10 having the foregoing structure.

The container main body 20 is formed from polyethylene into a hollow cylinder and is comprised of a substantially tube-like cylinder 22, a bottom enclosure 24, the neck 26, and a sealing section 28. The cylinder 2 is formed into a substantially tube-like shape and has an upper end 23. This cylinder 22 serves as the main body of the sealant container A1. A circular outlet port 23*a* is formed in the upper end 23, and the bottom enclosure 24 is provided along an inner wall 30 in the vicinity of the rearmost end of the cylinder 22. Specifically, the bottom enclosure 24 is formed like a piston which is slibable along the cylinder 22. The neck 26 is placed in the position of the outlet port 23*a* formed in the upper end 23 of the container main body 20. This neck 26 has a substantially hollow cylindrical shape and has a male screw thread cut in its outer circumference. The diameter of the neck 26 and the inner diameter of the outlet port 23*a* of the container main body 20 are the same, and they are connected with each other. A joint between the upper end 23 and the neck 26 is curved; namely, a joint between the outlet port 23*a* and the neck 26 is curved. The sealing section 28 has a substantially circular shape and is formed from a metal film or from a composite material consisting of metal and a plastic film. This sealing section 28 is stuck to the inner wall of the upper end 23 so as to cover at least the outlet port 23*a*.

In the container main body 20, the cylinder 22, the neck 26, and the bottom enclosure 24 are formed from polyethylene, and the cylinder 22 and the neck 26 are formed integrally with each other.

The container main body 20 is filled with a sealant in the following way. Specifically, while the sealing section 28 is labeled to the inner wall of the container main body 20 of the sealant container A1 so as to cover the outlet port 23*a*, a sealant K is poured and filled in the container main body 20 from the rear opening of the container main body 20. Then, the bottom enclosure 24 is fitted into the container main body 20.

The nozzle 40 as a whole forms a cap-shaped hollow member and has a front end 42 and a rear end 44. This nozzle 40 is formed from the same material as that of the container main body 20 and is integrally formed with the front end 42 and the rear end 44. The front end 42 has a sharp-pointed substantially cone shape, and the rearmost portion of the front end 42 is smaller in diameter than the opener 10. A regulating wall 43 is formed between the front end 42 and the rear end 44. While the opener 10 is provided in the neck 26, and the nozzle 40 is attached to the neck 26, the regulating wall 43 of the nozzle 40 prevents the opener 10 from moving upwards, or in the direction in which the sealant is poured. More specifically, in the state in which the nozzle 40 is attached to the neck 26, the regulating wall 43 fixedly positions the opener 10 so as to hold the cutting section 14 of the opener 10 in close proximity to the sealing section 28. The rear end 44 has a substantially cylindrical shape, and a female screw thread is cut in the inner wall of the rear end 44 so as to permit screwing in of the male screw cut in the outer circumference of the neck 26.

The opener 10 is provided in the neck 26 of the main body 20. When placing the opener 10 in the neck 26, the cutting section 14 of the opener 10 is first inserted into the neck 26 while the slit 18 is closed. As a result, the front end of the cutting section 14 of the opener 10 comes into close proximity to the sealing section, so that the upper end of the neck 26 becomes level with the upper end of the main body 12 of the opener 10 (i.e., the end of the opener 10 opposite to its end formed into the cutting section 14).

Preferably, the opener 10 is placed in the neck 26 while the width of the slit 18 is made small to reduce the diameter of the opener 10 after the sealant K has been filled in the container main body 20. If the sealant K is filled in the container main body 20 while the opener 10 is placed in the neck 26, the sealing section 28 may be pressed toward the neck 26 to thereby break. However, if the sealant K is filled in the container main body 20 without the opener 10, there will be no risk of erroneous fracture of the sealing section 28. This opener 10 is readily placed in the neck 26 by virtue of the slit 18. Further, the elastic action resulting from the closing or opening of the slit 18 enables the reliable press-fitting of the opener 10 into the inner wall of the neck 26. Further, since the slit 18 enables a certain extent of contraction of the outside diameter of the main body 12, the opener 10 can flexibly cope with variations in the inner diameter of the neck 26 of the sealant container A1.

With reference to FIGS. 6, 7*a*, 7*b*, and 11, a method of using the sealant container A1 having the foregoing structure will be described.

Figure 6:
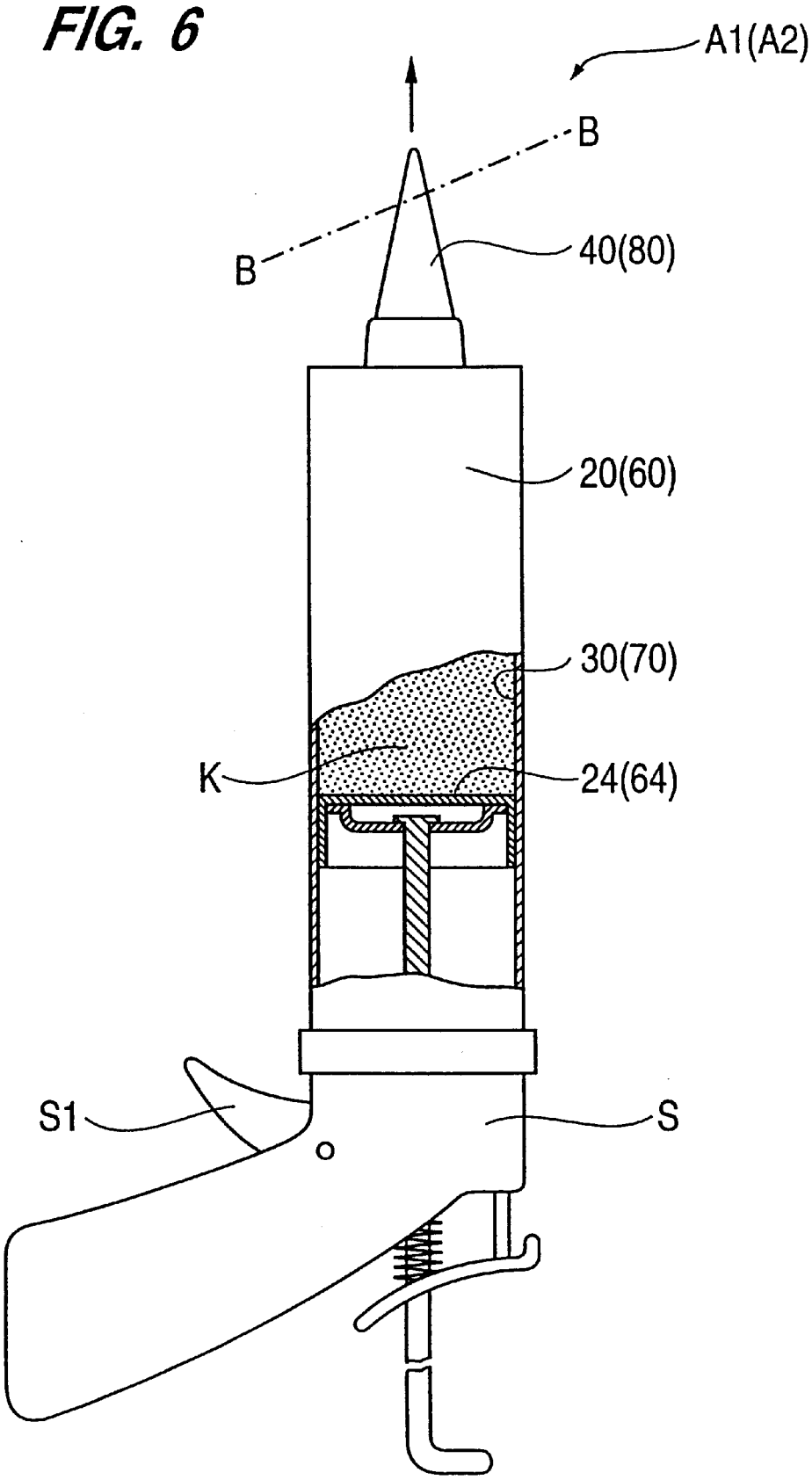
FIG. 6 is a partially-cutaway longitudinal cross section of the sealant container while it is set in a sealant extruding apparatus.

As illustrated in FIG. 6, the front end of the nozzle 40 of the sealant container A1 is obliquely cut away along line B—B. Subsequently, as illustrated in FIG. 6, the sealant container A1 is set in a sealant extruding apparatus S (see S10 in FIG. 11). Specifically, the bottom enclosure 24 of the sealant container A1 is attached to the sealant extruding apparatus S, and a trigger S1 of the sealant extruding apparatus S is depressed (see S11 in FIG. 11). The pressing action of the trigger S1 causes the sealant extruding apparatus S to extrude the sealant. Then, the bottom enclosure 24 moves while being pressed against the neck 26. This results in application of pressure to the sealant K filled in the sealant container A1.

Figure 7A:
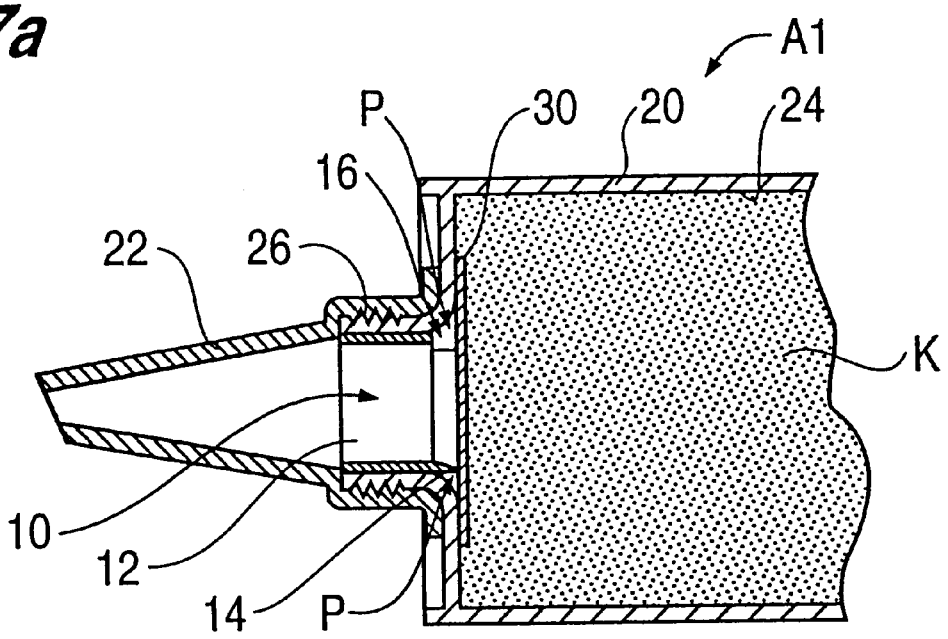
FIG. 7*a* is an enlarged fragmentary sectional view illustrating the principal elements of the sealant container before the sealant extruding apparatus is actuated.
Figure 7B:
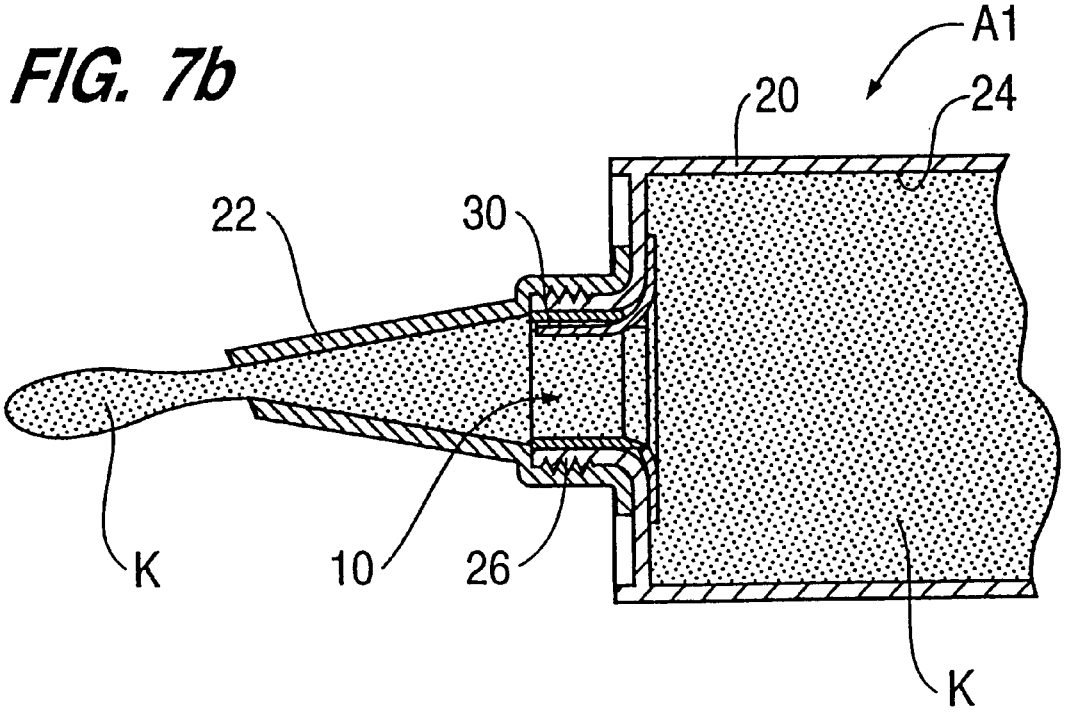
FIG. 7*b* is an enlarged fragmentary sectional view illustrating the principal elements of the sealant container after the sealant extruding apparatus has been actuated.

As illustrated in FIGS. 7*a* and 7*b*, the sealant K presses the sealing section 28 as a result of propagation of the pressure exerted on the sealant K, so that the sealing section 28 bulges out towards the neck 26 and comes into pressed contact with the cutting section 14 of the opener 10. As a result of the contact between the cutting section 14 and the sealing section 28, the sealing section 28 becomes fractured. Since the joint between the lower end of the neck 26 and the upper end 23 is curved, a space P is formed between the tip end of the cutting section 14 of the opener 10 and the joint, thereby improving the performance of the cutting section 14 to a much greater extent. As a result, it becomes more easy to break the sealing section 28.

The sealant K is extruded from the opened end of the nozzle 22 by way of the fractured sealing section 28 and the neck 26 of the main body 20. The thus-extruded sealant is filled into gaps, etc., formed in a building.

As described above, the sealant container A1 is provided with the foregoing opener 10, and hence the sealant can be extruded while breaking the sealing section 28 by only actuating the sealant extruding apparatus S to be used in filling sealant into gaps. Therefore, it is not necessary to break sealing sections one at a time at the expense of effort through use of another tool, as is the case with the conventional sealant container, thereby enabling improvements in the filling efficiency. Further, since there is no need to break the sealing section in another operation through use of a tool for breaking purposes, a risk of staining the tool is eliminated. The sealing section is broken only immediately before the sealant is extruded, and therefore the sealant is prevented from becoming set.

Figure 1:
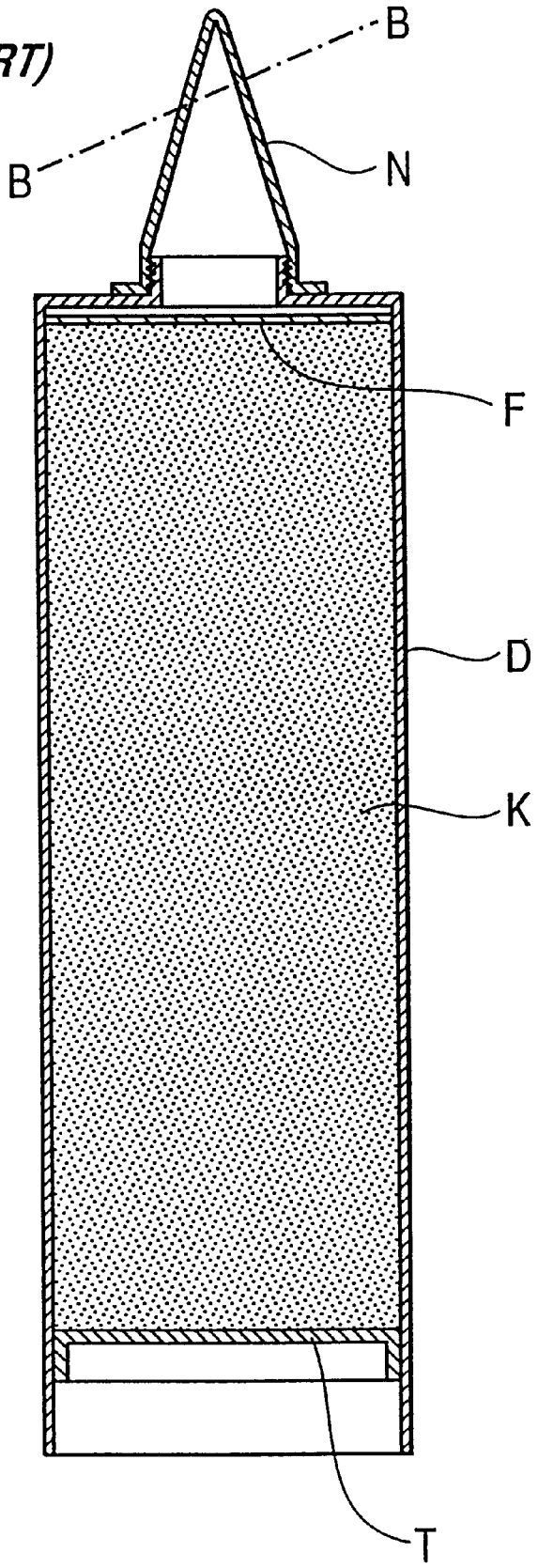
FIG. 1 (RELATED ART)
FIG. 1 is a longitudinal cross-section of a conventional sealant container.
Figure 2:
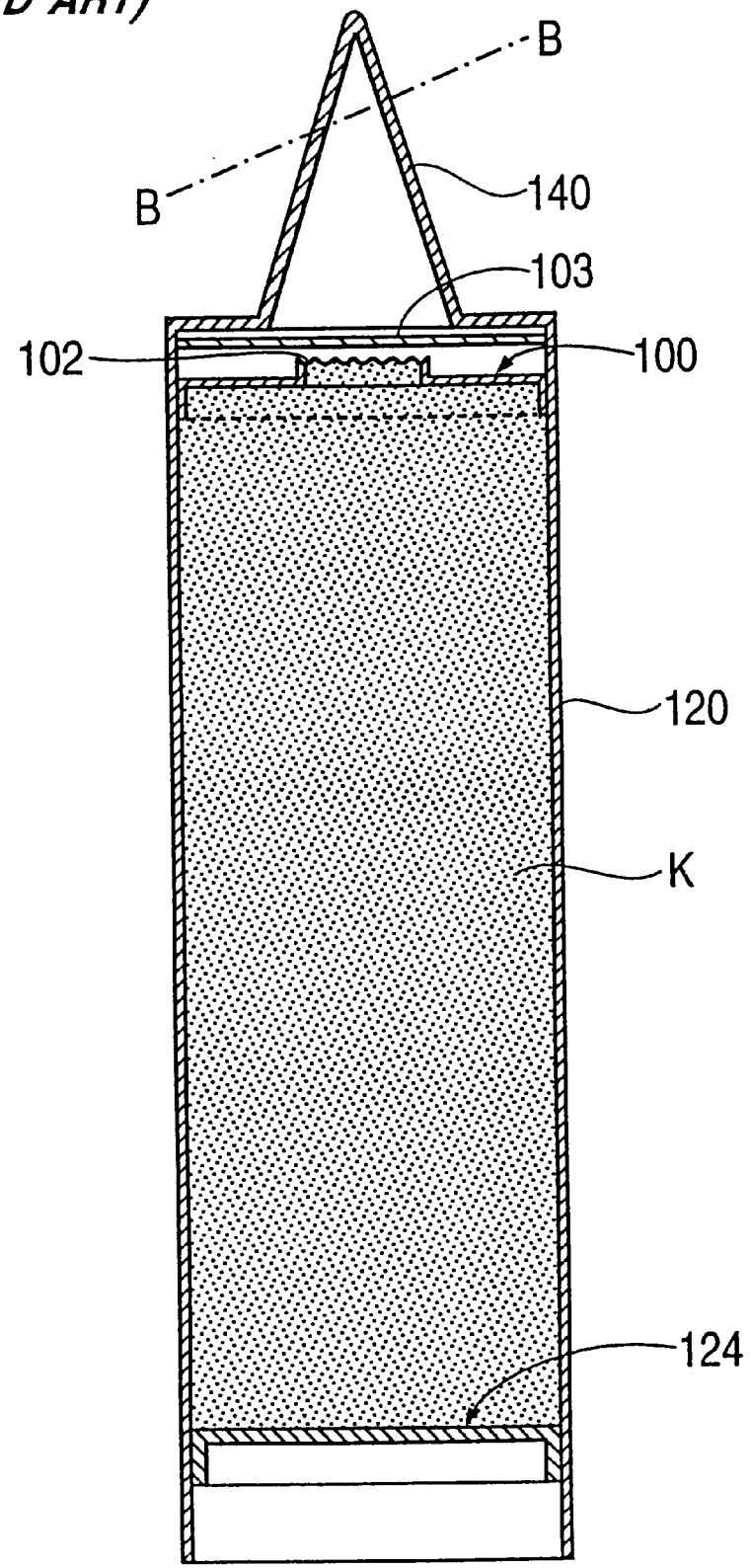
FIG. 2 (RELATED ART)
FIG. 2 is a longitudinal cross-section of another conventional sealant container with an opener.

Further, there is no risk of erroneous fracture of the sealing section 28 when filling the sealant into the sealant container A1. As illustrated in FIG. 2, for the case where the opener is provided in the main body of the sealant container between the sealing section and the bottom enclosure, and where the cutting section of the opener is brought into pressed contact with the sealing section by means of the pressure resulting from actuation of the sealant extruding apparatus, there is a risk of erroneous fracture of the sealing section when the sealant is previously filled into the sealant container. In contrast, there is no such risk in the sealant container of the present embodiment. Accordingly, the filling of the sealant container A1 with the sealant K does not require a high degree of attention, in turn improving the efficiency of filling operations.

Since the notch 16 is formed in the cutting section 14 of the opener 10, the sealing section 28 can be easily broken. In short, the edges 16*a* on both longitudinal sides of the notch 16 cause the fracture of the sealing section 28, and hence the time period required to break the sealing section 28 can be reduced. Particularly, by virtue of the slit 18 formed in the opener 10, the opener 10 becomes slightly tilted downwardly within the neck 26 when the sealant ejection operation is performed, thereby making it easy for the edges 16*a* to come into contact with the sealing section 28.

A total of the length of the main body 12 and the length of the cutting section 14 of the opener 10 is equal to the entire length of the neck 26 of the sealant container A1. Since the regulating wall 43 formed on the nozzle 40 prevents the upward movement of the opener 10, the sealing section 28 can be broken easily. More specifically, in the state in which the nozzle 40 is attached to the neck 26, the opener 10 is fixedly positioned while its cutting section 14 is held in close proximity to the sealing section 28, and therefore the sealing section 28 can be easily broken. Further, the opener 10 is press-fitted to substantially the entire circumference of the inner wall of the neck 26, and therefore the degree of press-fitting of the opener 10 to the neck 26 is increased, thereby making it possible to break the sealing section 28 efficiently.

Even in the case of the sealant container A1 without the opener 10; namely, the sealant container A1 only comprising the main body 20 and the nozzle 40, it is only necessary to attach the opener 10 having the previously-described structure to the neck 26 when using the sealing container A1. Therefore, the manufacture of the sealant container A1 as a whole becomes very easy.

Next, an explanation will be given of an opener for use with a sealant container and a sealant container using this opener according to a second embodiment of the present invention.

Figure 8A:
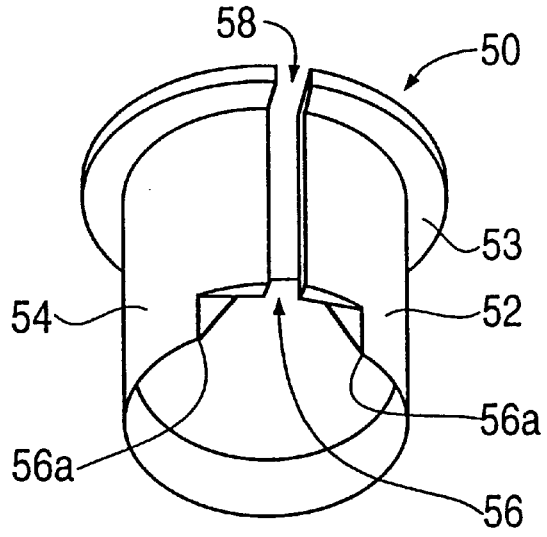
FIG. 8*a* is a perspective view of an opener according to a second embodiment of the present invention.
Figure 8B:
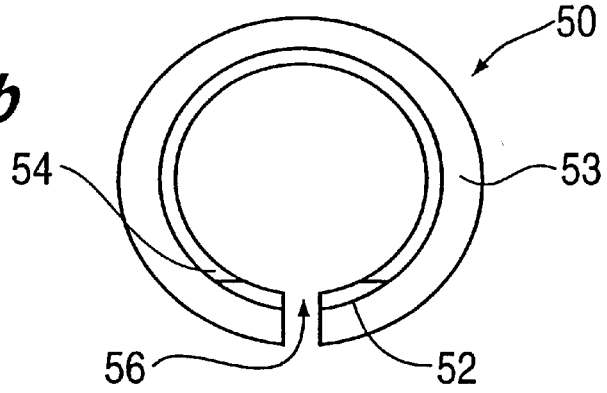
FIG. 8*b* is a bottom view of the opener in FIG. 8*a;*
Figure 8C:
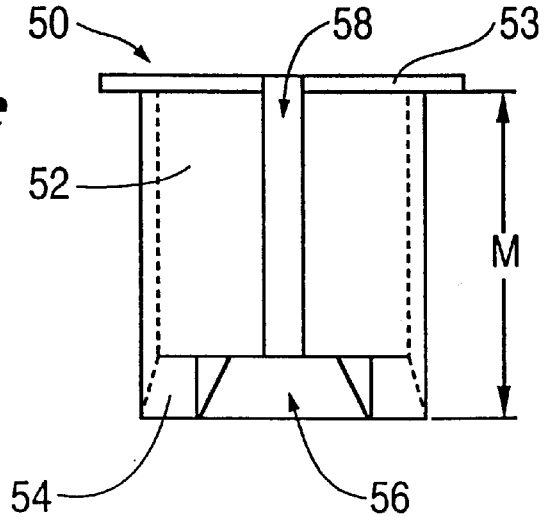
FIG. 8*c* is a front view of the opener in FIG. 8*a;*

As illustrated in FIGS. 8*a*, 8*b*, and 8*c*, the opener of the second embodiment is substantially the same in structure as that of the first embodiment. The difference between them is in that the opener of the second embodiment has a flange.

More specifically, an opener 50 of the sealant container, according to a second embodiment, is comprised of a main body 52, a flange 53, a cutting section 54, a notch 56, and a slit 58.

As in the case with the first embodiment, the main body 52 is formed from polyethylene into a hollow cylinder and has such an outer diameter as to enable fitting into the internal diameter of a neck 66 of a sealant container A2 (see FIG. 9), which will be described later.

The flange 53 is formed in a substantial ring shape, like a brim, along the outer circumference of the main body 52. In short, the flange 53 protrudes outside along the circumference of the end of the main body 52. The flange 53 is integrally formed with the main body 52. The flange 53 can fit into an annular groove 86 formed in the internal wall of the nozzle 80 of the sealant container A2, which will be described later.

Further, as is the case with the first embodiment, the cutting section 54 is integrally formed with the main body 52 in the shape of an externally offset circular bit. Specifically, the end of the main body 52 opposite to its end along which the flange 53 is formed, is formed into the cutting section 54. The cutting section 54 has a substantially wedge-shaped cross section.

Figure 9:
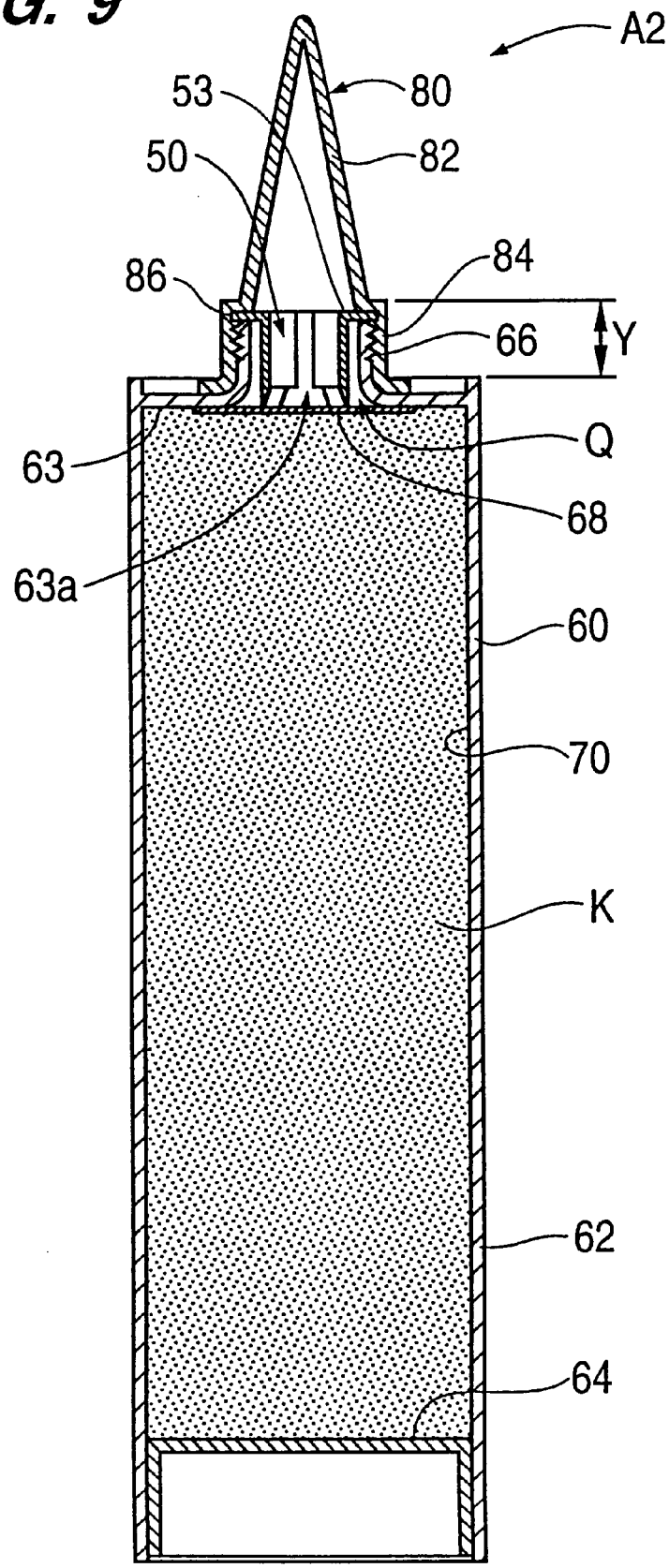
FIG. 9 is a longitudinal cross-section of a sealant container according to the second embodiment.

As illustrated in FIGS. 8*c* and 9, a length M which is a total of the length of the main body 52 and the length of the cutting section 54 is equal to a length Y from the innermost edge of the neck 66 of the sealant container A2, which will be described later, to an outlet port 63*a* formed in a container main body 60.

As is the case with the first embodiment, the notch 56 is substantially rectangularly formed in one area of the cutting section 54. The notch 56 is wider than the slit 58 and communicates with the same, and is formed such that the slit 58 is formed at the longitudinal center of the notch 56. Since the cutting section 54 has a substantially-wedge shaped cross section, edges 56*a* at both longitudinal ends of the notch 56 become pointed.

The diameter of the opener 50 is substantially equal to the inner diameter of the neck 66 of the sealant container A2, which will be described later. The slit 58 is formed at the longitudinal center of the notch 56 from the flange 53 of the main body 52 so as to communicate with the cutting section 54. The opener 50 is formed from polyethylene, and the above-described constituent sections 52, 53, 54, 56, and 58 are integrally formed with the opener 50 as a whole.

The sealant container A2 which uses the opener 50 having the foregoing structure will be described.

As is illustrated in FIGS. 4 and 9, the sealant container A2 is the same in appearance as the sealant container A1 and is comprised of the container main body 60, a nozzle 80, and the opener 50 having the foregoing structure.

The container main body 60 is formed from polyethylene into a hollow cylinder and is comprised of a substantially tube-like cylinder 62, a bottom enclosure 64, the neck 66, and a sealing section 68. The cylinder 62 is formed into a substantially tube-like shape and has an upper end 63. A circular outlet port 63*a* is formed in the upper end 63. This cylinder 62 serves as the main body of the sealant container A2. The bottom enclosure 64 is provided along an inner wall 70 in the vicinity of the rearmost end of the cylinder 62. Specifically, the bottom enclosure 64 is formed like a piston which is slidable along the cylinder 62. The neck 66 is placed in the position of the outlet port 63*a* formed in the upper end 63. This neck 66 has a substantially hollow cylindrical shape and has a male screw thread cut in its outer circumference. The diameter of the neck 66 and the inner diameter of the outlet port 63*a* of the container main body 60 are the same, and they are connected with each other. A joint between the outlet port 63*a* and the neck 66 is curved. The sealing section 68 has a substantially circular shape and is formed from a metal film or from a composite material consisting of metal and a plastic film. This sealing section 68 is labeled to the inner wall of the upper end 63 so as to cover at least the outlet port 63*a*.

In the container main body 60, the cylinder 62, the neck 66, and the bottom enclosure 64 are formed from polyethylene, and the cylinder 62 and the neck 66 are integrally formed with each other.

The container main body 60 is filled with a sealant in the following way. Specifically, as is the case with the first embodiment, while the sealing section 68 is stuck to the outlet port 63*a* of the sealant container A2, a sealant K is poured and filled into the container main body 60 from the bottom enclosure 64 of the container main body 60. Then, the bottom enclosure 64 is fitted into the container main body 60.

The nozzle 80 as a whole forms a cap-shaped hollow member and is substantially the same in structure as the nozzle 40 of the first embodiment. The difference between the nozzles 80 and 40 is in that an annular groove 86 is formed in the nozzle 80. Specifically, the nozzle 80 is integrally formed from a front end 82 and a rear end 84. This nozzle 80 is formed from the same material as that of the container main body 60. The front end 82 has a sharp-pointed substantially cone shape, and the rear end 84 is substantially cylindrically formed. A female screw thread is cut in the inner wall of the rear end 84 so as to permit screwing in of the male screw cut in the outer circumference of the neck 66. The annular groove 86 is provided along in the vicinity of the boundary between the front end 82 and the rear end 84. More specifically, the annular groove 86 is provided adjacent to the end of the female screw thread. It is impossible to form the annular groove 86 in an area other than the boundary; for example, in the middle of the female screw thread in terms of manufacturing restrictions. Therefore, the annular groove 86 is not usually provided in the female screw thread. The flange 53 of the opener 50 can fit into the annular groove 86. The entire diameter of the annular groove 86 is equal to or slightly larger than the outer diameter of the flange 53. Further, the width of the annular groove 86 is set so as to become equal to or slightly larger than the thickness of the flange 53.

The opener 50 is provided in the nozzle 80. When placing the opener 50 in the nozzle 80, the flange 53 of the opener 50 is first inserted into the nozzle 80 while the slit 58 is closed. The flange 53 fits into the annular groove 86, thereby fixing the opener 50 within the nozzle 80. When the nozzle 80 is screwed into the neck 66, the flange 53 is sandwiched between the innermost end of the neck 66 and the inner wall of the rear end 84. Further, the main body 52 and the cutting section 54 of the opener 50 are positioned a slight distance away from the neck 66. The opener 50 is fitted into the neck 66, and the front end of the cutting section 64 comes into close proximity to the sealing section 68. In short, in a state in which the nozzle 80 with the opener 50 is attached to the neck 66, the cutting section of the opener 50 is in close proximity to the sealing section 68. Since the opener 50 has the slit 58 formed therein, the opener 50 can be easily inserted into the nozzle 80 by pinching the opener 50 so as to close the slit 58. Further, the elastic action resulting from the opening or closing action of the slit 58 enables the reliable fitting of the flange 53 of the opener 50 into the annular groove 86.

Preferably, the opener 50 is placed in the nozzle 80 after the sealant K has been filled into the container main body 60 of the sealant container A2. If the sealant K is filled into the container main body 60 while the nozzle 80 with the opener 50 is attached to the container main body 60, the sealing section 68 may be pressed toward the neck 66 to thereby break. However, if the sealant K is filled into the container main body 60 without the nozzle 80 having the opener 50 attached thereto or with the nozzle 80 which does not have the opener 50, there will be no risk of erroneous fracture of the sealing section 68.

With reference to FIGS. 6, 10*a*, 10*b*, and 11, a method of using the sealant container A2 having the foregoing structure will be described.

As in the case with the first embodiment, as illustrated in FIG. 6, the front end of the nozzle 80 of the sealant container A2 is cut away obliquely. Subsequently, as illustrated in FIG. 6, the sealant container A2 is set in the sealant extruding apparatus S (see S10 in FIG. 11). Specifically, the bottom enclosure 64 of the sealant container A2 is attached to the sealant extruding apparatus S, and the trigger S1 of the sealant extruding apparatus S is depressed (see S11 in FIG. 11), thereby pressing the bottom enclosure 64 toward the neck 66. This results in application of a pressure to the sealant K filled in the sealant container A2.

Figure 10A:
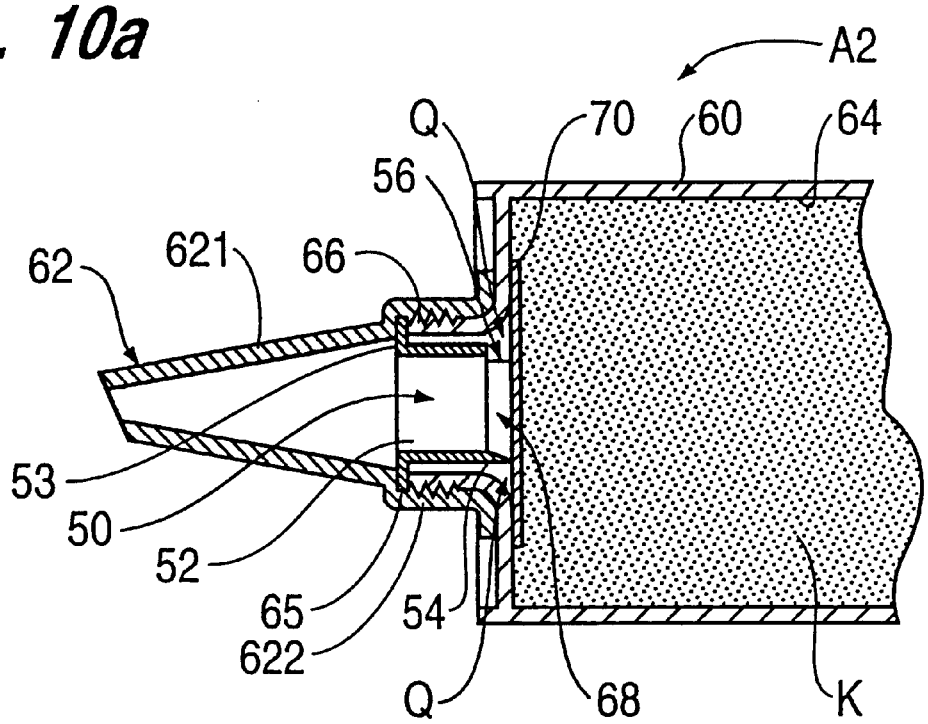
FIG. 10*a* is an enlarged fragmentary sectional view illustrating the principal elements of the sealant container of the second embodiment before the sealant extruding apparatus is actuated.
Figure 10B:
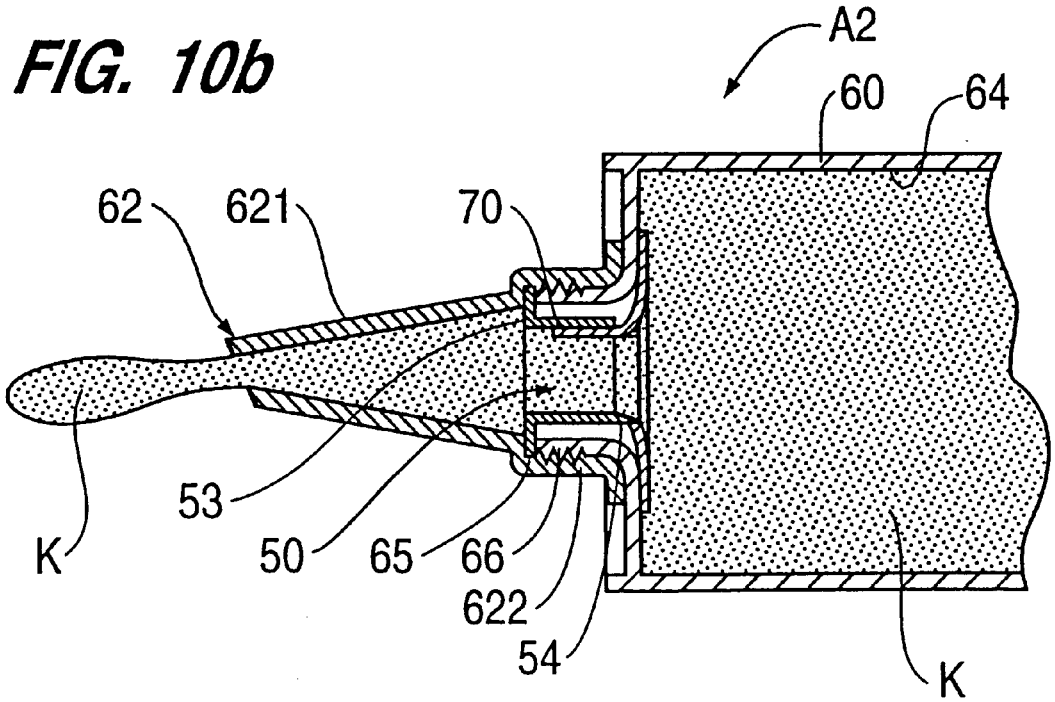
FIG. 10*b* is an enlarged fragmentary sectional view illustrating the principal elements of the sealant container of the second embodiment after the sealant extruding apparatus has been actuated.
Figure 11:
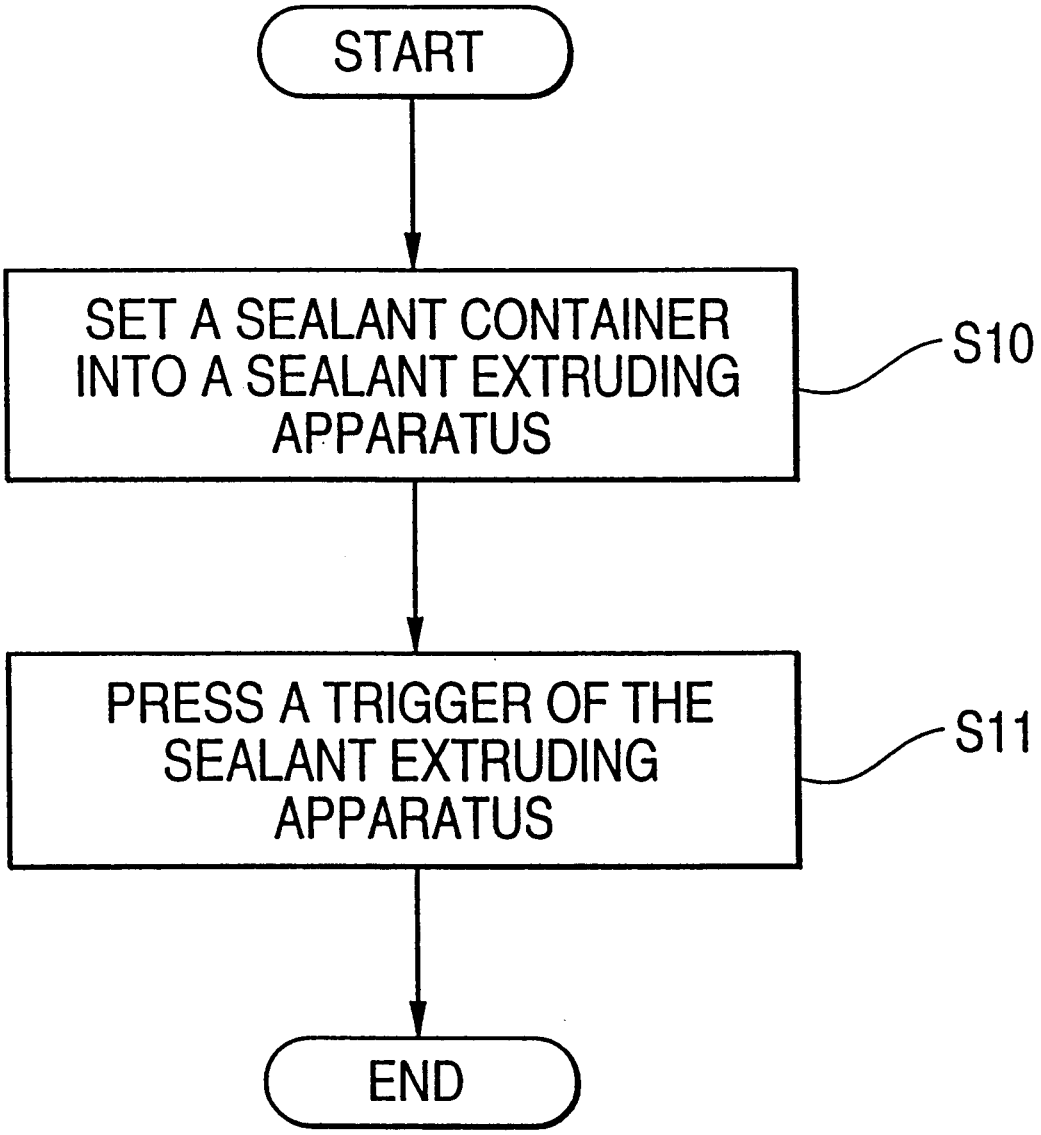
FIG. 11 is a flowchart showing a method of opening the sealant container according to the present invention.

As illustrated in FIGS. 10*a* and 10*b*, the sealant K presses the sealing section 68 as a result of propagation of the pressure exerted on the sealant K, so that the sealing section 68 bulges out towards the neck 66 and comes into pressed contact with the cutting section 54 of the opener 50. As a result of the contact between the cutting section 54 and the sealing section 68, the sealing section 68 becomes fractured. Since the joint between the lower end of the neck 66 and the upper end 63 is curved, the space P is formed between the tip end of the cutting section 54 of the opener 50 and the joint, thereby improving the performance of the cutting section 54 to a much greater extent. Resultantly, it becomes easier to break the sealing section 68. By virtue of the flange 53, the main body 52, etc., of the opener 50 can be spaced apart from the neck 66. As a result, the opener 50 can be applied to a sealant container in which a corresponding joint of the main body is not curved.

The sealant K is extruded from the opened end of the nozzle 80 by way of the fractured sealing section 68 and the neck 66 of the main body 82.

As described above, the sealant container A2 is provided with the foregoing opener 50, and hence the sealant can be extruded while breaking the sealing section 68 by only actuating the sealant extruding apparatus S to be used in filling a sealant in gaps. Therefore, it is not necessary to break sealing sections one at a time at the expense of effort through use of another tool, as is the case with the conventional sealant container, thereby enabling improvements in the filling efficiency. Further, since there is no need to break the sealing section in another operation through use of a tool for breaking purposes, the risk of staining the tool is eliminated. The sealing section is only broken immediately before the sealant is extruded, and therefore the sealant is prevented from becoming set.

Further, there is no risk of erroneous fracture of the sealing section 68 when filling the sealant into the sealant container A2. Since the opener 50 is placed in the nozzle 80, there is no risk of erroneous fracture of the sealing section 68 when the sealant K is filled into the sealant container A2, so long as the nozzle 80 itself is previously removed from the neck 66 or the opener 50 is previously removed from the nozzle 80. Accordingly, the filling of the sealant container A2 with the sealant K does not require a high degree of attention, in turn improving the efficiency of filling operations.

Since the notch 56 is formed in the cutting section 54 of the opener 50, the sealing section 68 can be easily broken. In short, the edges 56*a* on both longitudinal sides of the notch 56 cause the fracture of the sealing section 68, and hence the time period required for fracture of the sealing section 68 can be reduced.

Since the opener 50 is fixedly placed in the nozzle 80 so as not to move upwards, the sealing section 68 can be broken easily. More specifically, in the sate in which the nozzle 80 is attached to the neck 66, the opener 50 is fixedly positioned while its cutting section 54 is held in close proximity to the sealing section 68, and therefore the sealing section 68 can be easily broken.

Even in the case of the sealant container A2 without the opener 50; namely, the sealant container A2 only comprising the main body 60 and the nozzle 80, it is only necessary to attach the opener 50 having the previously-described structure to the neck 66 when using the sealing container A2. Therefore, the manufacture of the sealant container A2 as a whole becomes very easy.

Although the sealant containers A1 and A2 in the previous embodiments have been described on the basis of the assumption that the main body of each sealant container has a cylindrical shape and a substantially circular cross section, the main body may be formed into a square or polygonal shape. In such a case, the bottom enclosure of each sealant container coincides in shape with the cross section of the main body.

Further, although the previous embodiments have been described on the basis of the assumption that the neck of the sealant container is cylindrical, the neck may have a square or polygonal cross section. In such a case, the outlet ports 23*a* and 63*a* coincide in shape with the cross section of the neck.

Although the container main body, the neck, the cap-shaped nozzle, and the bottom enclosure are formed from polyethylene in the previous embodiments, they may be formed from paper, metal, or another synthetic resin other than polyethylene. Alternatively, they may not be formed from the same material. For example, the outer surface of the container main body may be made of paper, and the inner wall of the container main body may be coated with metal. Alternatively, the neck and the bottom enclosure may be made from metal, whereas the cap-shaped nozzle may be made of synthetic resin.

Although the openers have been described in the previous embodiments based on the assumption that the slit is formed in each of the openers, the slit may be omitted. In the first embodiment, if the opener can be fitted and fixed relative to the inner diameter of the neck, the slit can be omitted. Moreover, in the second embodiment, if the opener can reliably fit into the nozzle, the slit can be omitted.

Although the openers have been described in the previous embodiments based on the assumption that they are substantially cylindrical with the exception of the slit formed therein, the openers are not limited to these types of openers. The openers may have a polygonal cross section; e.g., a square cross section. For example, if the neck of the sealant container is triangular, the opener is designed so as to have a triangular cross section corresponding to the shape of the neck. In contrast, even if the neck has a substantially circular cross section, the opener needs not to have a substantially circular cross section. The opener may have; for example, a triangular cross section.

Although the previous embodiments have been described on the basis of the assumption that the notch is formed in each of the openers, the notch may be omitted. Even in such a case, the cutting section can fracture the sealing section. Further, although the previous embodiments have been described on the basis of the assumption that the slit is formed substantially at the longitudinal center of the notch, the slit is not limited to this position but may be formed in another position of the notch.

Although the previous embodiments have been described on the basis of the assumption that the opener is formed from polyethylene, it may be formed from metal or another synthetic resin other than polyethylene.

Although the previous illustrative embodiments have been described on the basis of the assumption that the cutting section of each of the openers has a pointed tip, the tip may be formed into a sawtooth shape.

Although the second embodiment has been described on the basis of the assumption that the flange of the opener is formed in the shape of a brim along the circumference of the main body of the opener, it needs not to be formed over the entire circumference. Specifically, the flange may be formed into; e.g., a radial pattern as viewed from the top. In such a case, the annular groove 86 formed in the nozzle 80 may be formed so as to coincide with the shape of the radially-formed flange.

Although the previous illustrative embodiments have been described on the basis of the assumption that the joint between the neck and the upper end is curved, the joint may be formed into a right-angled shape. In this case, however, the front end of the cutting section of the opener provided in the neck must be spaced apart from the inner wall of the neck while maintaining close proximity to the sealing section.

Although the sealing section used in the previous embodiments are stuck to the outlet port formed in the container main body, it may be tensilely attached to the inner wall of the vicinity of the outlet port. Even in this case, the sealing section must be provided so as to cover the outlet port formed in the container main body.

Although the previous embodiments have been described on the basis of the assumption that the cutting sections 14 and 54 of the openers 10 and 50 are externally offset bites, they may be internally offset bites.

The shape, size, or material of the sealant containers and the openers for use therewith according to the present invention, and the way in which the constituent elements of the sealant container or the opener operate, may be arbitrarily determined within an extent to which the previously-described objects, operation, and advantageous results of the present invention, which will be described later, are achieved. It goes without saying that the modifications of the present invention do not result in changes in the principles underlying the present invention.

The foregoing description of the preferred embodiments of the present invention has been presented for purposes of illustration and description. It is not intended to be exhaustive or to limit the invention to the precise form disclosed. Obvious modifications or variations are possible in the light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

I claim:

1. An opener for breaking a sealing section provided in a sealant container in order to shield a sealant filled in a sealant container from outside air, compromising:

a hollow shape having first and second open ends; and a cutting section provided at the first end of the opener, the cutting section having a cutting edge generally parallel to the second end.

2. The opener as defined in claim 1, wherein a slit is formed in the opener in an axial direction, said slit extending from the second end toward the first end.

3. The opener as defined in claim 2, wherein a notch is formed in the first end of the opener, and the cutting section formed at the first end of the opener, with the exception of the notch, has a substantially wedge-shaped cross section.

4. The opener as defined in claim 2, wherein the opener has a substantially circular or polygonal cross section.

5. The opener as defined in claim 2, wherein a flange is formed so as to protrude along a periphery of the second end of the opener, the flange being co-planer with the second end.

6. The opener as defined in claim 1, wherein a notch is formed in the first end of the opener, and the cutting section formed at the first end of the opener, with the exception of the notch, has a substantially wedge-shaped cross section.

7. The opener as defined in claim 6, wherein the opener has a substantially circular or polygonal cross section.

8. The opener as defined in claim 6, wherein a flange is formed so as to protrude along a periphery of the second end of the opener, the flange being co-planar with the second end.

9. The opener as defined in claim 1, wherein the opener has a substantially circular or polygonal cross section.

10. The opener as defined in claim 9, wherein a flange is formed so as to protrude along a periphery of the second end of the opener, the flange being co-planar with the second end.

11. The opener as defined in claim 1, wherein a flange is formed so as to protrude along a periphery of the second end of the opener, the flange being co-planer with the second end.

12. The opener as defined in claim 1, wherein a slit is formed in the opener in an axial direction, and a notch is formed in the opener at the first end, said slit extending from the second end and terminating in the notch.

13. A sealant container for storing a sealant and for filling desired areas with the sealant, comprising:

a main body including a container for containing the sealant and a neck connected to the container for permitting the discharging of the sealant from the container, and a sealing section provided between the container and the neck in order to shield the sealant from the outside air; and a nozzle attached to an outside surface of the neck of the main body.

14. The sealant container as defined in claim 13, wherein a joint between the neck and the container is curved, and a regulating wall is formed on an inside surface of the nozzle for holding a cutting section of an opener in close proximity to the sealing section within the neck while the nozzle is attached to the neck.

15. The sealant container as defined in claim 14, wherein the nozzle has a substantially conical front end followed by a rear end having a screw thread thereon for threading to the neck, and the regulating wall is formed on a joint between the front end and the rear end.

16. The sealant container as defined in claim 13, wherein an annular groove is formed on an inside surface of the nozzle for receiving a flange of an opener.

17. The sealant container as defined in claim 16, wherein the nozzle has a substantially conical front end followed by a rear end having a screw thread thereon for threading to the neck, and the annular groove is formed along an edge of the rear end where the rear end is adjoined to the front end.

18. The sealant container as defined in claim 16, further comprising the opener fitted in the annular groove of the nozzle for breaking the sealing section provided in the sealant container, wherein the opener comprises a hollow shape open at both ends, a cutting section formed at one axial end of the opener, and the flange formed so as to protrude along a periphery of the end of the opener opposite to the end formed into the cutting section.

19. The sealant container as defined in claim 18, wherein, in a state where the nozzle is attached to the neck, the opener is fixedly positioned while the cutting section of the opener is in close proximity to the sealing section.

20. The sealant container as defined in claim 13, further comprising a separate opener located in the neck for breaking the sealing section provided in the sealant container, wherein the opener comprises a hollow shape open at both ends, and a cutting section formed at one axial end of the opener.

21. The sealant container as defined in claim 20, wherein a slit is formed in the opener in the axial direction.

22. The sealant container as defined in claim 20, wherein a notch is formed in the end of the opener formed into the cutting section, and the cutting section formed at the end of the opener, with the exception of the notch, has a substantially wedge-shaped cross section.

23. The sealant container as defined in claim 20, wherein the opener has a substantially circular and polygonal cross section.

24. The sealant container as defined in claim 20, wherein a flange is formed so as to protrude along a periphery of the end of the opener opposite to the end formed into the cutting section.

25. The sealant container as defined in claim 20, wherein, in a state where the nozzle is attached to the neck, the opener is fixedly positioned while the cutting section of the opener is in close proximity to the sealing section.

26. A method of opening a sealant container used for filling desired areas with a sealant, comprising the steps of:

installing in a sealant extruding apparatus, the sealant container including a container main body for housing the sealant which is comprised of a neck for permitting the discharging of the sealant, a sealing section for shielding the sealant from the outside air provided at a base end of the neck, a bottom enclosure for sealing the sealant, and a nozzle attached to the neck of the main body, and an opener provided in the neck and having a hollow shape open at both ends, and a cutting section provided at one axial end of the opener; and actuating the sealant extruding apparatus to thereby press the bottom enclosure of the sealant container, so that the sealing section is brought into pressed contact with the cutting section and is fractured.

* * * * *